US006547529B2

(12) United States Patent
Gross

(10) Patent No.: US 6,547,529 B2
(45) Date of Patent: Apr. 15, 2003

(54) DRY TANK SHUTDOWN SYSTEM FOR PUMPS

(76) Inventor: Donald Gross, 7240 Standard Dr., Hanover, MD (US) 21076

( * ) Notice: Subject to any disclaimer, the term of this patent is extended or adjusted under 35 U.S.C. 154(b) by 46 days.

(21) Appl. No.: 09/938,942

(22) Filed: Aug. 24, 2001

(65) Prior Publication Data

US 2003/0039549 A1 Feb. 27, 2003

(51) Int. Cl.[7] ..... F04B 49/00

(52) U.S. Cl. ..... 417/36; 417/4; 417/9; 417/53

(58) Field of Search ..... 417/36, 15, 28, 417/33, 44.1, 45, 9, 4, 53

(56) References Cited

U.S. PATENT DOCUMENTS

| | | | |
|---|---|---|---|
| 3,352,246 | A | 11/1967 | Inoue |
| 3,993,945 | A | 11/1976 | Warmoth et al. |
| 4,357,131 | A | 11/1982 | Guillemot |
| 4,362,994 | A | 12/1982 | Goldsmith et al. |
| 4,388,043 | A | 6/1983 | Preiss |
| 4,553,552 | A | 11/1985 | Valdespino et al. |
| 4,654,598 | A | 3/1987 | Arulanandan et al. |
| 4,747,751 | A | 5/1988 | Guillemot |
| 5,120,198 | A | 6/1992 | Clark |
| 6,122,956 | A | 9/2000 | Klausner et al. |

*Primary Examiner*—Charles G. Freay
*Assistant Examiner*—Michael K. Gray
(74) *Attorney, Agent, or Firm*—Rankin, Hill, Porter & Clark LLP

(57) ABSTRACT

A sensor, system, and method for determining whether sufficient water is present to safely operate a pump. The sensor includes first and second conductive fittings that are physically and electrically isolated from one another by a third non-conductive fitting. Electrodes are secured to the exteriors of the first and second fittings and are electrically connected to an electronic detection device. The electronic detection device applies a voltage across the first and second fittings and detects a current flowing between the first and second fittings. The current is correlated to the presence of water between the first and second fittings. If the detected current is below a predetermined minimum, the electronic detection device turns off the pump to prevent dry-running thereof.

15 Claims, 1 Drawing Sheet

DRY TANK SHUTDOWN SYSTEM FOR PUMPS

BACKGROUND OF THE INVENTION

1. Field of the Invention

The present invention is generally directed toward pump control systems and methods and, more particularly, toward a system and method for preventing a pump from running dry.

2. Description of Related Art

Many pumps, such as those used on marine vessels, have a finite supply of water. Other pumps may have their water supply interrupted because of a blockage or break in the supply-side plumbing. Unfortunately, these types of pumps are susceptible to damage from running-dry.

Traditionally, and in response to this potential danger, these types of pumps have included water pressure sensors or pump temperature sensors to turn the pump off. However, such measures may be inadequate or too slow to prevent damage to the pump.

It has also been proposed to install sensors in the pump intake conduit and to use these sensors to detect whether liquid is present in the intake conduit. For example, U.S. Pat. Nos. 3,993,945; 4,553,552; 4,357,131; and 6,122,956 all show different sensor arrangements wherein the sensor is embedded in the conduit sidewall, or projects from the conduit sidewall, and is used to detect whether liquids are present in the conduit. These patents show that embedded sensor arrangements, and using information from the embedded sensors to control a pump, are known in the art. However, these arrangements suffer from the disadvantage that the sensors are expensive to manufacture, install, and implement, and require substantial modifications to known equipment and plumbing. Moreover, the exposed sensors may be damaged during use, rendering inoperable any pump activation and shut-down system incorporating the sensors.

Therefore, there exists a need in the art for a device for sensing liquid in a conduit and a method for controlling a pump in response to sensed liquid that is reliable, inexpensive, and durable.

SUMMARY OF THE INVENTION

The present invention is directed toward a liquid sensor for sensing the presence of liquid in a conduit, and toward a pump control system that shuts down the pump in response to the signals from the liquid sensor.

In accordance with the present invention, a sensor for detecting the presence of water in a passageway communicating with a pump includes first and second conductive fittings and a third non-conductive fitting disposed between the first and second fittings. The first and second fittings have electrodes secured to their exterior surfaces. Water to be detected flows through the sensor, and electrical current flowing between the first anid second fittings is used to determine whether water is present in the sensor.

In accordance with another aspect of the invention, a pump shutdown system includes a sensor and an electrical detection device. The sensor is a flow-through sensor defining a portion of a water passageway leading toward or away from a pump to be controlled. The sensor includes a first conductive fitting, a second conductive fitting, and a third non-conductive fitting extending between and sealingly secured to the first and second conductive fittings. The sensor defines a portion of a water passageway and is in fluid communication with the pump. The first and second members have electrodes secured to their exteriors. An electronic detection device is also provided and electrically connected to the electrodes. The electronic detection device is operable to apply a voltage across the first and second conductive members and to detect a current flowing between the first and second conductive members. The electronic detection device detects a current flowing between the first and second conductive members and shuts down the pump if the detected current flow is less than a predetermined minimum.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
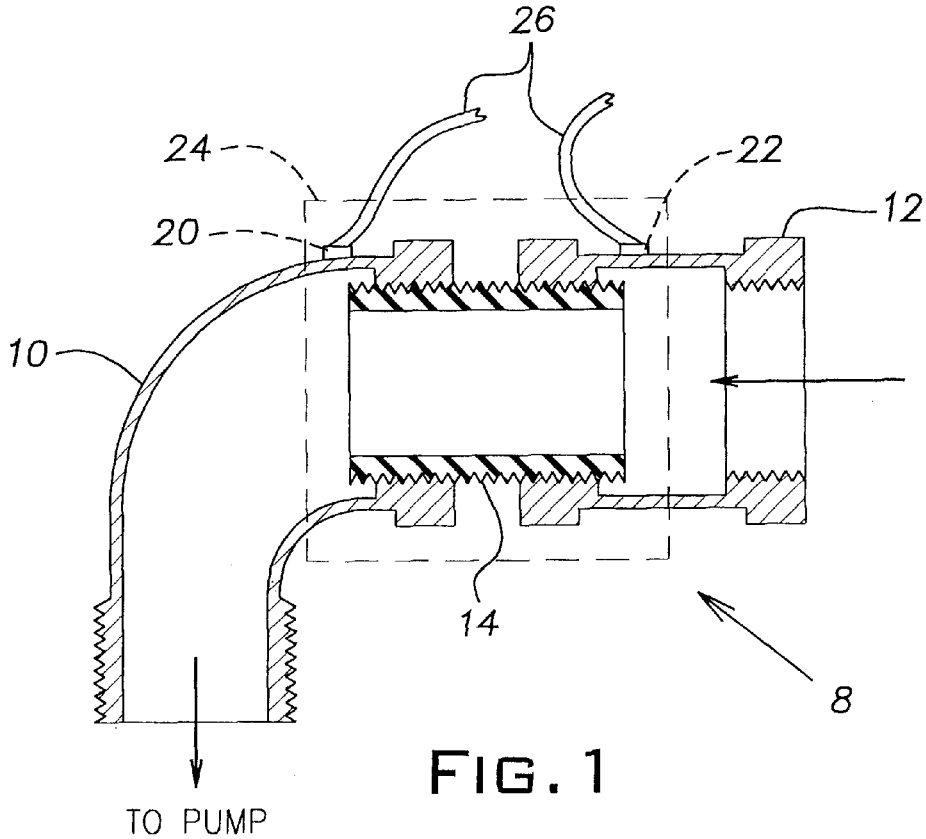
FIG. 1 is a cross-sectional view of a preferred embodiment of the sensor according to the present invention; and, FIG. 2 is a schematic illustration of the pump control system according to the present invention.
Figure 2:
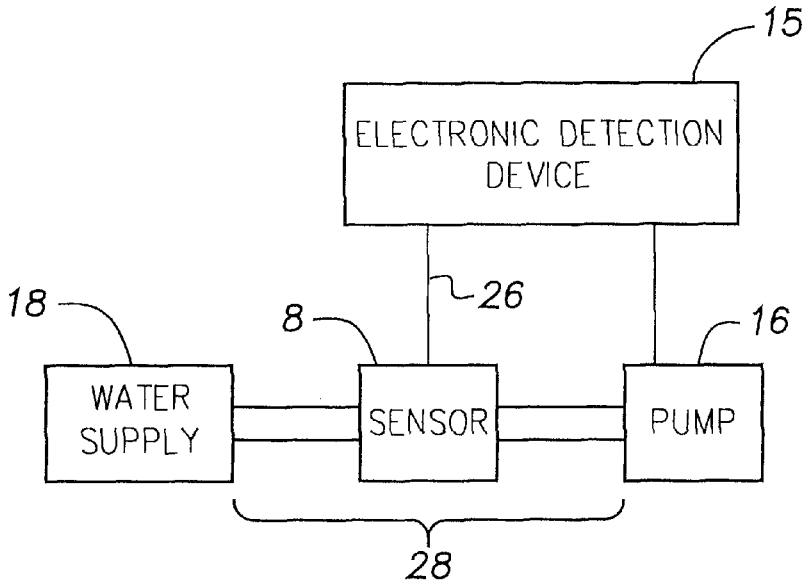

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

With reference to the drawing figures, the sensor 8 according to the present invention is shown to include a first conductive fitting 10, a second conductive fitting 12, and a third non-conductive fitting 14 disposed between the first and second conductive fittings 10, 12. The third fitting 14 serves to isolate the first fitting 10 from the second fitting 12, both physically and electrically.

The first and second conductive fittings 10,12 serve as terminals, and are electrically connected to an electronic detection device 15 or control unit that applies a voltage across the fittings 10, 12 and senses current flow therebetween, as will be apparent from the following description. In the illustrated embodiment, the first fitting 10 is arranged relatively closest to a pump 16 and the second fitting 12 is arranged relatively closest the liquid supply source 18. It is considered apparent that the positions of the first and second fittings 10, 12 could be switched without changing the function of the sensor 8 or the system incorporating the sensor 8. Moreover, the first, second, and third fittings 10, 12, 14 can be of any shape or orientation. Also, it is contemplated that the sensor 8 be disposed relatively downstream the pump 16, rather than upstream as illustrated.

Each of the first and second fittings 10, 12 has an electrode 20, 22 secured to an outer surface thereof. The electrodes 20, 22 may be secured by mechanical fasteners. However, it is preferred that a more permanent and reliable means of attachment, such as welding or soldering, be employed to affix the electrodes 20, 22 to the first and second fittings 10, 12.

Although various means of water-tight mechanical attachment may be employed, the third fitting 14 preferably has external threads to permit threaded securement of the first and second fittings 10, 12 thereto. As such, the first and second fittings 10, 12 include internal threaded surfaces to facilitate securing of the third fitting 14 therein. Preferably, after the first, second, and third fittings 10, 12, 14 are arranged and mechanically connected, and the electrodes 20, 22 are attached to the first and second fittings 10, 12, the assembly is encased or enclosed in a shell 24. The shell 24 may be made from a plastic or epoxy that is molded in place, or may be a removable cover that is sealed to the fittings 10, 12. In any event, the shell 24 will sealingly engage the sensor 8 and will maintain the exterior of the first and second fittings 10, 12 electrically isolated from one another. The shell 24 will also prevent or minimize corrosion, which may otherwise cause unwanted electrical connection between the first and second fittings.

The sensor 8 of the present invention is a conduit and forms a portion of the water flow passageway 28 from the water supply source 18 to the pump 16. Wires 26 extending from the electrodes 20, 22 are connected to an electronic detection device 15. Control wires 30 extend from the electronic detection device 15 to the pump 16. The electronic detection device 15 includes a DC power supply and is operable to apply a constant voltage across the fittings 10, 12 and to sense current through the fittings 10, 12. The electronic detection device 15 includes memory in which current flow is correlated to the presence or absence of water in the sensor 8. Accordingly, current flow is used by the detection device 15 to determine whether sufficient water is present in sensor 8. If water is not present, or not present in a sufficient amount/volume, the detention device 15 turns off the pump 16.

More specifically, the electronic detection device 15 employs an algorithm such that the voltage developed across the sensor 8 is correlated to a predetermined minimum current. Detected current below the predetermined minimum current is indicative of a lack of water in the sensor 8. In response to such an indication, the electronic detection device 15 will shutdown the pump 16. Detected current equal to or above the predetermined minimum current is indicative of the presence of sufficient water in the sensor 8. Accordingly, the electronic detection device 15 will not shutdown the pump 16.

The present invention has been described herein with particularity, but it is noted that the scope of the invention is not limited thereto. Rather, the present invention is considered to be possible of numerous modifications, alterations, and combinations of parts and, therefore, is only defined by the claims appended hereto.

What is claimed is:

1. A sensor for use in detecting a presence of water in a passageway communicating with a pump, comprising:

a first conductive member;

a second conductive member;

a third, non-conductive member, said third member being disposed between said first and second conductive members;

said first and second members have electrodes secured thereto and water to be detected flows through the passageway, a portion of which is defined by said first, second and third members; and means for determining whether water is present in said third, non-conductive member, by measuring electrical current flow between said first and second members.

2. The sensor according to claim 1, wherein said first, second, and third members are sealingly connected to one another.

3. The sensor according to claim 2, wherein said first, second, and third members are plumbing fittings.

4. The sensor according to claim 3, wherein said first, second and third members are encased in a shield to prevent corrosion thereof.

5. The sensor according to claim 4, wherein said shield is molded over the first, second, and third members.

6. The sensor according to claim 4, wherein said shield is elastomeric and removable.

7. The sensor according to claim 4, wherein said electrodes are permanently attached to the first and second members.

8. A pump shutdown system comprising:

a sensor comprising:

a first conductive member;

a second conductive member; and, a third, non-conductive member, said third member being disposed between said first and second conductive members;

said first and second members have electrodes secured thereto and water to be detected flows through the passageway, a portion of which is defined by said first, second and third members;

an electrical detection device that is electrically connected to said electrodes and operable to establish a voltage across said first and second conductive members and to detect a current flowing between said first and second conductive members, wherein said detected current flow between said first and second members is used by said electrical detection device to determine whether water is present in said sensor and to shut down said pump if sufficient water is not present.

9. The pump shutdown system according to claim 8, wherein said first, second, and third members are sealingly connected to one another.

10. The pump shutdown system according to claim 9, wherein said first, second, and third members are plumbing fittings.

11. The pump shutdown system according to claim 10, wherein said first, second and third members are encased in a shield to prevent corrosion thereof.

12. The pump shutdown system according to claim 11, wherein said shield is molded over the first, second, and third members.

13. The pump shutdown system according to claim 11, wherein said shield is elastomeric and removable.

14. The pump shutdown system according to claim 11, wherein said electrodes are permanently attached to the first and second members, and wherein wires extend from said electrodes, through said shield, to said electronic detection device.

15. A method for determining whether sufficient supply water is present to operate a pump, comprising the steps of:

providing a sensor comprising first and second conductive members and a third non-conductive member disposed between said first and second conductive members, said sensor defining a portion of a water passageway and being in fluid communication with said pump, said first and second members having electrodes secured to an exterior thereof;

providing an electronic detection device that is electrically connected to said electrodes and operable to apply a voltage across said first and second conductive members and to detect a current flowing between said first and second conductive members;

using said electronic detection device to detect a current flowing between said first and second conductive members; and, if said detected current is below a predetermined minimum current, shutting off said pump.

* * * * *

UNITED STATES PATENT AND TRADEMARK OFFICE

CERTIFICATE OF CORRECTION

PATENT NO. : 6,547,529 B2
DATED : April 15, 2003
INVENTOR(S) : Gross

It is certified that error appears in the above-identified patent and that said Letters Patent is hereby corrected as shown below:

Title page,
Item [56], References Cited, U.S. PATENT DOCUMENTS, insert:
-- 3,718,556 2/1973 Rohrback, G.H.
5,090,871 2/1992 Story et al.
3,560,847 2/1971 Boyd et al. --.

Signed and Sealed this

Twenty-sixth Day of August, 2003

JAMES E. ROGAN
*Director of the United States Patent and Trademark Office*